US007052407B2

(12) United States Patent
Patterson

(10) Patent No.: US 7,052,407 B2
(45) Date of Patent: May 30, 2006

(54) GOLF PUTTING PRACTICE DEVICE

(76) Inventor: Owen M. Patterson, 21223 Mire Dr., Abita Springs, LA (US) 70420-3115

( * ) Notice: Subject to any disclaimer, the term of this patent is extended or adjusted under 35 U.S.C. 154(b) by 793 days.

(21) Appl. No.: 09/977,331

(22) Filed: Oct. 16, 2001

(65) Prior Publication Data

US 2002/0045488 A1 Apr. 18, 2002

Related U.S. Application Data

(60) Provisional application No. 60/240,837, filed on Oct. 17, 2000.

(51) Int. Cl.
*A63B 69/36* (2006.01)

(52) U.S. Cl. ..... 473/180

(58) Field of Classification Search ..... 473/172–174, 473/180, 181, 186–189, 182, 191, 185, 164; D21/789
See application file for complete search history.

(56) References Cited

U.S. PATENT DOCUMENTS

| | | | | |
|---|---|---|---|---|
| 1,287,903 | A | | 12/1918 | Daily |
| 1,473,051 | A | | 11/1923 | Scott |
| 1,510,239 | A | | 9/1924 | Monosmith |
| 1,682,601 | A | | 8/1928 | Cunningham |
| 1,798,140 | A | | 3/1931 | Byers |
| 1,823,487 | A | | 9/1931 | Clear |
| 2,236,869 | A | | 4/1941 | Daigle |
| 2,283,462 | A | | 5/1942 | Richie |
| 2,737,392 | A | | 3/1956 | Stokes |
| 2,899,207 | A | * | 8/1959 | Billinghurst ..... 473/188 |
| 3,048,405 | A | | 8/1962 | McCaul |
| 3,065,971 | A | | 11/1962 | Coles |
| 3,512,262 | A | * | 5/1970 | Smyk et al. ..... 473/180 |
| 3,647,216 | A | * | 3/1972 | Breslow ..... 273/123 R |
| 3,659,856 | A | | 5/1972 | Fatur |
| D230,598 | S | * | 3/1974 | Goodrich ..... D21/789 |
| 3,891,221 | A | | 6/1975 | Gordon |
| D245,306 | S | * | 8/1977 | Ryden et al. ..... D21/789 |
| D251,863 | S | | 5/1979 | Gordon |
| 4,368,888 | A | | 1/1983 | Ren |
| 4,861,033 | A | | 8/1989 | Miner |
| 4,906,006 | A | | 3/1990 | Sigunick |
| 5,013,042 | A | | 5/1991 | Garnes |
| D323,357 | S | | 1/1992 | Mulay |
| 5,100,147 | A | | 3/1992 | Mull |
| 5,257,808 | A | | 11/1993 | Mueller et al. |
| 5,261,670 | A | | 11/1993 | Mull |
| 5,275,404 | A | | 1/1994 | Dimaano et al. |
| 5,282,626 | A | | 2/1994 | Millar |
| D354,540 | S | | 1/1995 | Wiedenmeier |
| 5,421,578 | A | | 6/1995 | Ames |
| 5,487,545 | A | | 1/1996 | Schindler |
| 5,584,768 | A | | 12/1996 | Lee |
| 5,588,918 | A | | 12/1996 | Eckman et al. |
| 5,735,751 | A | | 4/1998 | Pacheco |
| D405,144 | S | | 2/1999 | Crum |

(Continued)

*Primary Examiner*—Mark S. Graham
(74) *Attorney, Agent, or Firm*—Shlesinger, Arkwright & Garvey LLP

(57) ABSTRACT

A golf putting practice device comprising a disk, the disk having an annular bottom portion, an annular central portion and an annular top portion, the annular bottom and the annular top portion being substantially similar in height, the central portion forming an annular outwardly extending member extending from said bottom and top portion and forming in cross section a substantially truncated conical configuration.

21 Claims, 3 Drawing Sheets

U.S. PATENT DOCUMENTS 5,997,406 A * 12/1999 Selton ..... 473/180
D444,529 S * 7/2001 Wagner ..... D15/29
6,279,245 B1 * 8/2001 Johnsen ..... 33/555.2
6,287,213 B1 * 9/2001 Selton ..... 473/180

* cited by examiner

FIG. 1
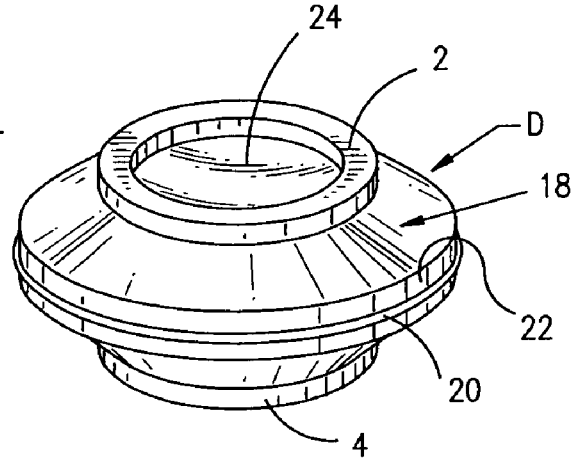
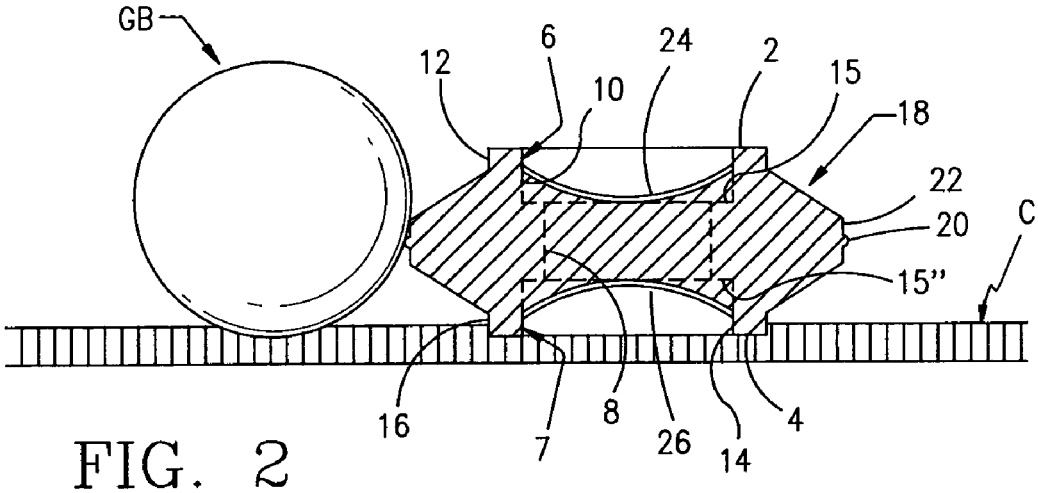
FIG. 2
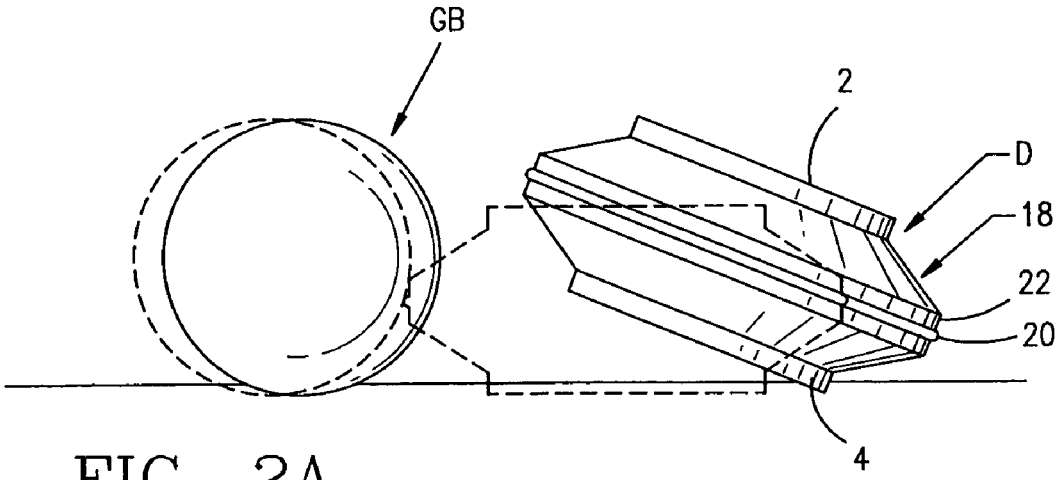
FIG. 2A

GOLF PUTTING PRACTICE DEVICE

CROSS-REFERENCE TO RELATED APPLICATIONS

This application is a nonprovisional application claiming the benefit of U.S. Provisional Application Ser. No. 60/240,837 filed on Oct. 17, 2000.

FIELD OF THE INVENTION

The present invention relates to a practice device for golfers and more particularly, a practice device for improving the putting stroke of a golfer.

BACKGROUND OF THE INVENTION

A putt is a golf stroke made on a putting green to play the ball into or near a hole. As is apparent, during a golf game the slope and length of the putting green will vary together with the distance of the ball from the hole. In such varied situations it is important for the golfer to not only correctly align the ball with the hole but to also adapt his putting stroke to take into account the slope of the green and distance between the ball and the hole. Many professional golfers believe the ball must be struck with a force sufficient to carry the ball anywhere from thirteen to twenty inches past the hole if missed. Professionals have proven that at this optimum speed, the putted ball approaching a hole will be less likely to prematurely break or curve off of the putting path. This is because a slower moving putted ball is more influenced by turf bumps and curves. And, a ball hit too fast may jump out of the hole completely, even if hit perfectly.

Devices for improving a players golf stroke during a putt are known. These prior art devices usually comprise various targets having cups, ramps, shallow holes, or complex rebound mechanisms for receiving and returning the ball to the user. For example, Des 405,144 to Crum, U.S. Pat. No. 1,823,487 to Clear, U.S. Pat. No. 2,283,462 to Richie, U.S. Pat. No. 5,257,808 to Mueller et al., U.S. Pat. No. 4,906,006 to Sigunick, U.S. Pat. No. 5,275,404 to Dimanno and U.S. Pat. No. 1,287,903 to Daily disclose disc-type devices in which the ball if stuck properly, goes into the center ring. None of these references tilt upwardly to indicate ball force. In all instances, the prior art practice devices are complex, cumbersome or simply ineffective. None of the prior art practice devices provide a visual means for assisting a user in optimizing the force with which the ball is hit.

OBJECTS AND SUMMARY OF THE INVENTION

It is an object of the invention to provide a golf putting practice device adapted to be used indoors or outdoors.

It is a further object of the present invention to provide a golf putting practice device that will provide the user with a visual indication corresponding to the force with which the ball has been struck.

It is still a further object of the invention to provide the user with immediate visual feedback as to whether the velocity provided to the ball is sufficient to result in a holed shot.

It is still a further object of the invention to operate on greens or carpets of different thicknesses of compressibility.

Another object of the present invention is to provide a golf putting practice device which is portable simple and light weight that could be put into a pants pocket with comfort, a golf bag, a briefcase, suitcase, a purse, or an office drawer.

It is another object of the present invention to provide a practice putting device that is attractive in appearance and can facilitate the installation of advertising logos, insignia and/or information for corporate and personal promotion or identification.

It is a still further object of the present invention to provide a golf putting practice device adapted to improve the players ability to correctly align the ball with the hole and optimize the force with which the ball is hit so that a desired ball velocity is generated as it travels towards the hole.

It is another object of the present invention to provide a practice putting device which is inexpensive and easy to manufacture.

Yet another object of the present invention is to train the golfer to become consistent in his putting stroke.

Yet still another object of this present invention is to provide disc design variations which can be installed on two separate disc i.e. one for short and firm carpet or turf and one for long carpet and turf.

In summary, this invention relates to a golf putting practice device to improve the golfer's putting stroke.

These and other objects will be apparent from the following description and drawings which are as follows.

BRIEF DESCRIPTION OF THE DRAWINGS

FIG. 1 is a perspective view of the golf putting practice device according to the present invention;

FIG. 2 is a diagramatic view a portion of which is shown in cross section with portions shown in phantom lines;

FIGS. 2A through 2D illustrate the degree of movement of the device upon impact with a golf ball.

DETAILED DESCRIPTION OF THE PREFERRED EMBODIMENTS

Figure 2B:
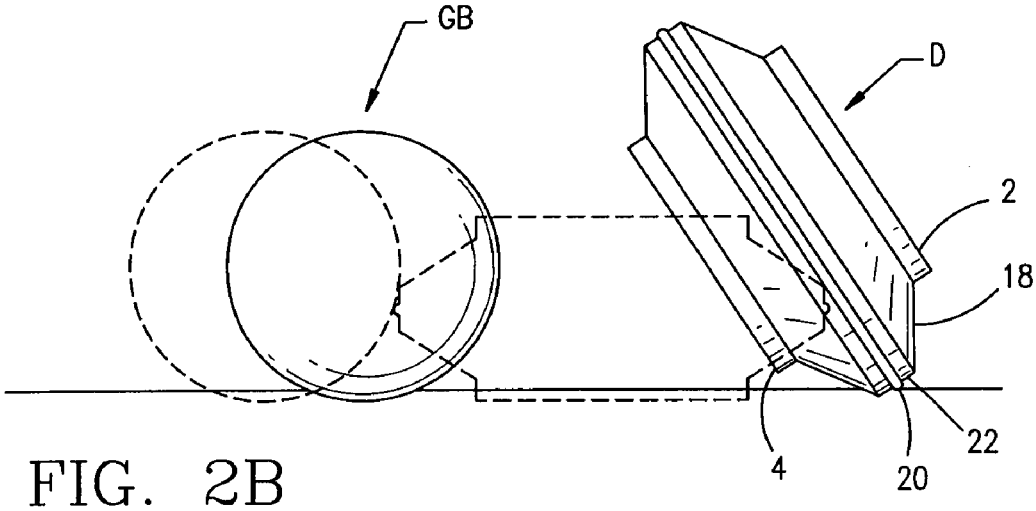

Turning to the drawings and in particular FIGS. 1 and 2, the practice device or disc D is shown. The device is about 2.68 inches in diameter, has a height of about 1.15 inches and a weight between about 30 to about 50 grams and a preferred weight of about 39 grams. The diameter of the device or disc D is less than the size of an actual hole or cup on a green by about the diameter of a standard golf ball GB.

The practice device D includes a top 2 and bottom 4 which are shown to be mirror images of each other. As is apparent, the device may be turned over with the top 2 functioning as a bottom or base and the bottom 4 functioning as a top. The practice device may be constructed from a variety of materials, including but not limited to wood, composites, and synthetic materials such as plastics or rubber. Practice device or disc D further includes partial bores 6 and 7 extending down from the top 2 and up from the bottom 4 and into the device D along a central axis (not shown). The partial bore may extend into the device D a depth between about 0.16 inch to about 0.57 inch when the device D has a height of about 1.15 inches as set forth above. A through bore 8 having a reduced diameter from the partial bores 6 and 7 is also provided and extends along the central axis of the device D and in communication with each partial bore 6 and 7. This through bore 8 is variable in diameter and may even be the same size as the partial bores 6 and 7 depending upon the nature of the construction materials. The through bore 8 is therefore provided or not provided and varied in diameter depending upon the construction materials selected so that optimum tilting of the device will occur in a manner as set forth below. This tilting is controlled by the weight of the device or disc D. Bore 6 has an inside annular surface 10 and an outer annular surface 12. Bore 7 has an inside annular surface 14 and an inside annular surface 16. Surface 10 and 14 bottom at shoulder 15 and 15'.

The device or disc D includes an annular ring member 18 projecting laterally from the outer annular surface 12 and 16 and further includes a circumferential leading edge or bead 20, which may be provided in a distinctive or highly visible color. The leading edge or bead 20 is positioned on surface 22 in a manner equidistant between the top 2 and bottom 4. Also shown are optional cover 24 and 26 which can be snap fitted or otherwise positioned into the partial bores 6 and 7 which may be provided with indicia or some other design (not shown) for use in advertising, or the like. Annular ring member 18 has in cross section a generally truncated conical configuration as illustrated in FIG. 2. The conical angle is from about 10° to about 20° with 15° preferred.

Figure 3:
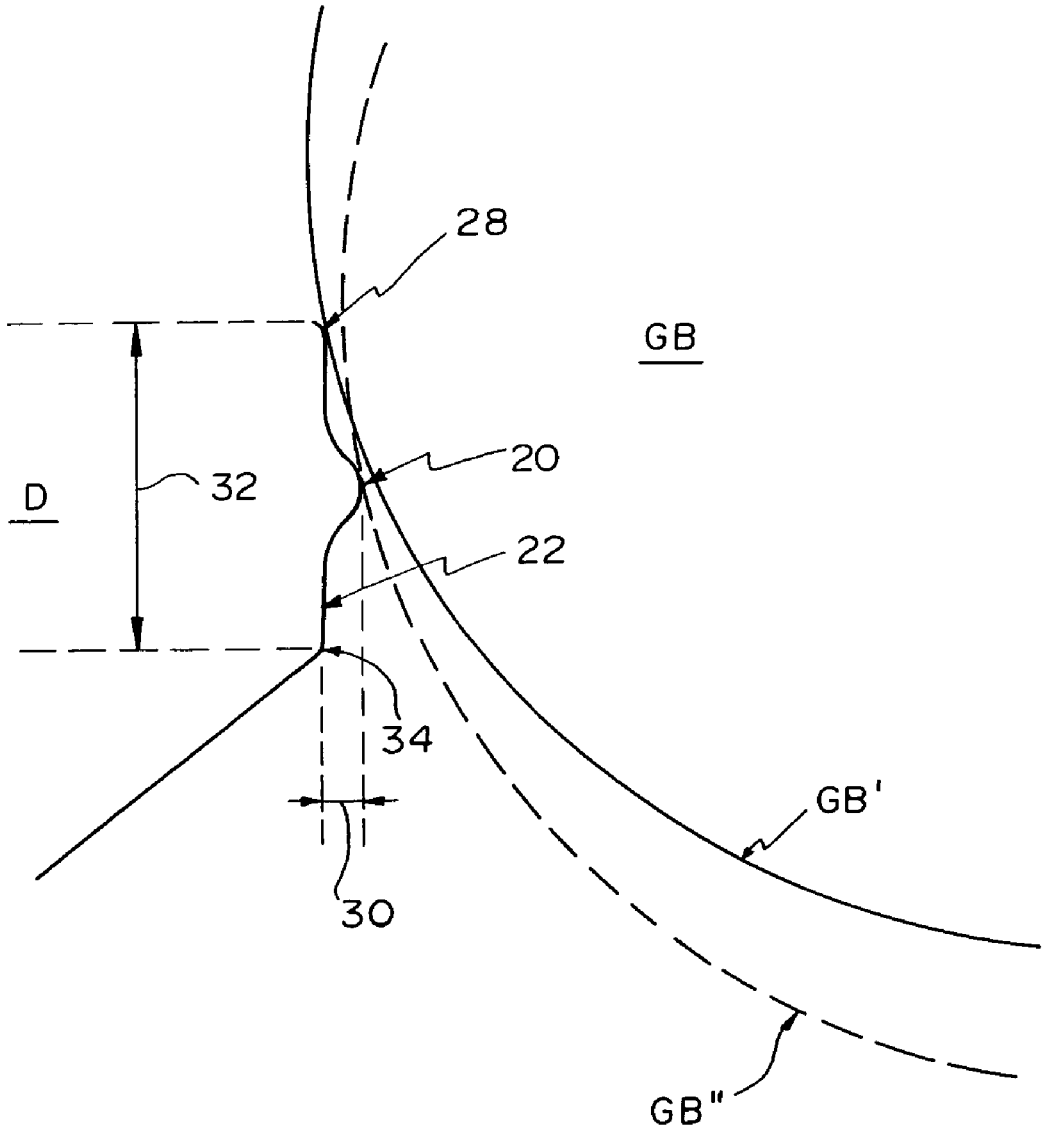
FIG. 3 is a schematic partially enlarged view of a golf ball contacting the leading edges of the device.

FIG. 3 shows the leading or circumferential edge 20 in greater detail wherein a golf ball GB is shown in position GB' and GB" striking the device D at two different locations depending upon the nature of the ground surface. For example, top edge 28 of surface 22 will be the point of impact against a golf ball GB' on green turf or a carpet that is short to average in length. On the other hand, with turf or carpet that is longer than average in length, the ball GB in position GB" and the device or disc D will deform, indent or compress somewhat into the turf or carpet C so that the leading or circumferential edge or bead 20 will be the point of impact against the golf ball GB. Accordingly, the device or disc D will operate on greens or carpets of different thicknesses or degrees of compressibility. Further note in FIG. 3 the distance 30 from the surface 22 to leading edge or bead 20 may extend from about 0.015 inch to about 0.09 inch with a preferred distance of 0.03 inch or 1/32 inch or less for a device having the weight and dimensions as set forth above. In addition, distance 32 extending from top edge 28 to bottom edge 34 may extend from about 0.062 inch to about 0.375 inch with a preferred distance of 0.125 inch for a device having a weight and dimension as set forth above.

Turning to FIGS. 2A through 2D the movement of the device D upon impact with a golf ball GB moving at various velocities is shown and with the golf ball GB and the putting device immediately prior to contact being shown in phantom lines. The device or disc D is placed onto a putting green or carpet C or other surface simulating a putting green and a golf ball GB is positioned a selected distance from the device D. If a putting stroke against the ball GB is made and the ball travels toward the device and at least contacts the top edge 28, a correct line from the ball to the hole has been achieved. This is shown in FIG. 2. However, in order to hole a shot, it is not only necessary to align the shot correctly, one must also provide the proper amount of velocity to the ball to ensure that the putted ball GB will not prematurely break before reaching the hole. The device D according to the present invention provides the user with immediate visual feedback as to whether the velocity provided to the ball is sufficient to result in a holed shot. This is feedback is achieved by the degree of tilt of the device D when it impacts against the golf ball GB. The degree of tilt for ball GB having the optimum velocity, that is, a velocity resulting in the ball GB traveling about 13 inches to about 20 inches beyond the location of the hole, is approximately ½ inch to about 1 inch. This is best shown in FIG. 2B wherein the device D will tilt upwardly a moderate amount upon contact with the golf ball GB.

The tilt up effect of the device is a reactive force resulting from the downward force of the moving ball as it strikes against either the top edge 28 or leading edge 20 of the device D constructed in the manner as set forth above.

Figure 2C:
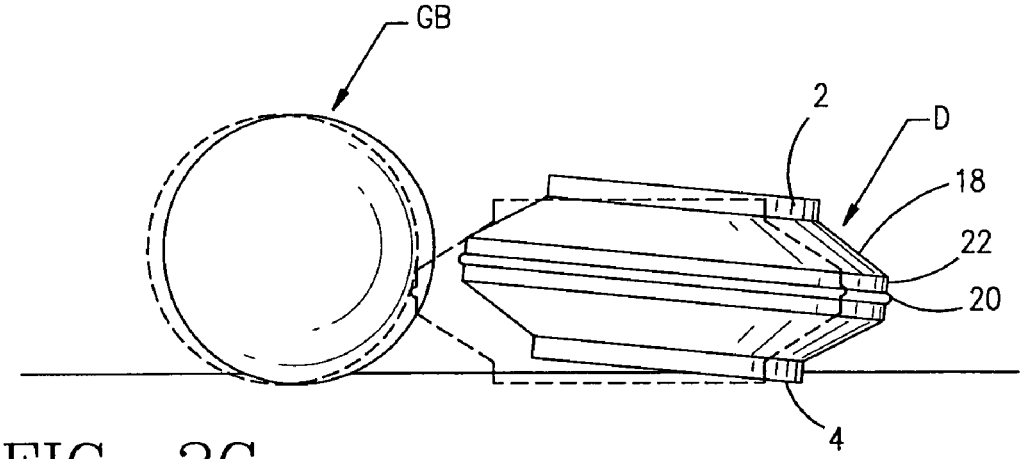
Figure 2D:
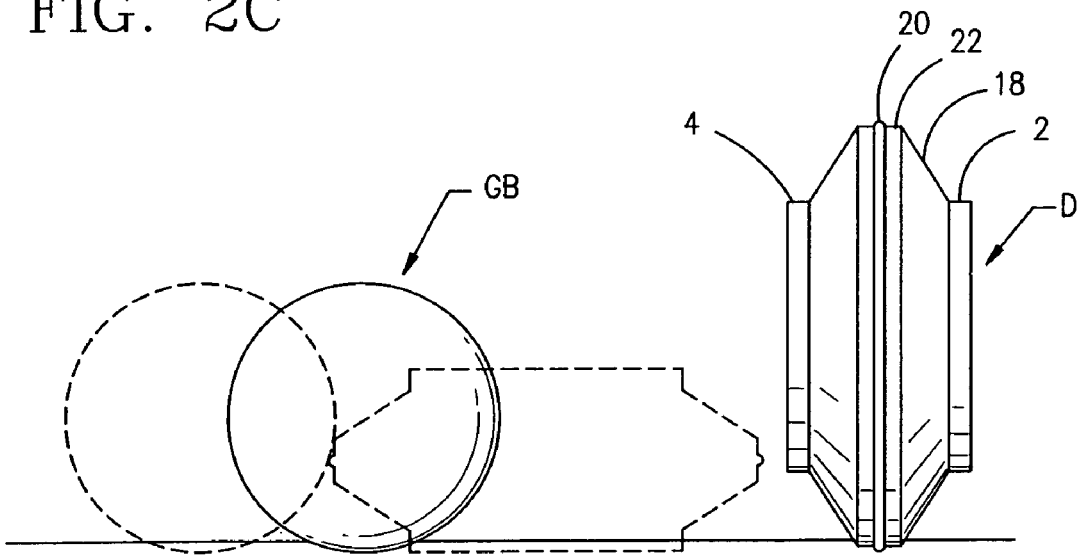

The remaining FIGS. 2B, 2C and 2D each show degrees of tilt which do not correspond to optimum ball velocity. For example, FIGS. 2B and 2D show excessive tilt of the device upon impact with the golf ball GB. This type of tilt corresponds to a ball velocity that is too great and would not result in a holed shot. On the other hand, FIG. 2C indicates a tilt that is less than moderate indicating the ball velocity was less than that required to minimize premature ball breaks.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

I claim:

1. A practice putting device comprising:

a) a disc;

b) an annular bottom portion;

c) an annular central portion;

d) an annular top portion;

e) said annular bottom and annular top portion being substantially similar in height;

f) said central portion having an annular outwardly extending member extending from said bottom and top portions and forming in cross section a substantially truncated conical configuration;

g) said truncated conical cone has a substantially flat surface; and h) said substantially flat surface includes an annular bead.

2. A practice putting device as in claim 1, wherein:

a) said disc having a weight of about from 30 grams to about 50 grams.

3. A practice putting device as in claim 2, wherein:

a) said weight is about 39 grams.

4. A practice putting device as in claim 1 and further comprising:

a) a bore extending from said top portion through said bottom portion.

5. A practice device as in claim 4, wherein:

a) said bore has top and bottom shoulders.

6. A practice device as in claim 4, wherein:

a) said bore has at least one insert.

7. A practice device as in claim 5, wherein:

a) said shoulders each have at least one insert positioned thereon.

8. A practice device as in claim 4, wherein:

a) said bore has a depth from about 0.16 inch to about 0.57 inch.

9. A practice device as in claim 8, wherein:

a) said depth is preferred 0.35 inch.

10. A practice device as in claim 1, wherein:

a) said flat surface extending a distance from about 0.015 inch to about 0.9 inch.

11. A practice device as in claim 10, wherein:

a) said distance is 0.03 inch.

12. A putting practice device comprising:

a) a disc;

b) an annular bottom portion;

c) an annular central portion;

d) an annular top portion;

e) said annular bottom and annular top portion being substantially similar in height;

f) said central portion having an annular outwardly extending member extending from said bottom and top portions and forming in cross section a substantially truncated conical configuration; and g) said top portion and said bottom portion are shown to be mirror images each other.

13. A putting practice device comprising:

a) a disc;

b) an annular bottom portion;

c) an annular central portion;

d) an annular top portion;

e) said annular bottom and annular top portion being substantially similar in height;

f) said central portion having an annular outwardly extending member extending from said bottom and top portions and forming in cross section a substantially truncated conical configuration; and g) said putting practice device has a diameter less than the size of an actual cup on a green by about the diameter of a standard golf ball.

14. A practice device as in claim 13, wherein:

a) said truncated conical configuration having an angle between about 10 degree to about 20 degree.

15. A practice device as in claim 14, wherein:

a) said truncated conical angle is about 15 degree.

16. A practice device as in claim 13, wherein:

a) said disc has a height from about 1.10 inch to about 1.20 inch.

17. A practice device as in claim 16, wherein:

a) said disc height is about 1.15 inch.

18. A practice device as in claim 13, wherein:

a) said disc having a diameter from about 2.50 inches to about 2.80 inches.

19. A practice device as in claim 18, wherein:

a) said diameter is about 2.68 inches.

20. A practice device as in claim 14, wherein:

a) said top and bottom portions are irregular.

21. A practice putting device as in claim 13, wherein:

a) said truncated conical cone has a substantially flat surface.

* * * * *